US007601401B2

(12) United States Patent
Hennessey

(10) Patent No.: US 7,601,401 B2
(45) Date of Patent: Oct. 13, 2009

(54) PROCESS FOR APPLYING FLUOROPOLYMER POWDER COATING AS A PRIMER LAYER AND AN OVERCOAT

(75) Inventor: Craig King Hennessey, Avondale, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 700 days.

(21) Appl. No.: 11/281,092

(22) Filed: Nov. 17, 2005

(65) Prior Publication Data

US 2006/0110601 A1 May 25, 2006

Related U.S. Application Data

(60) Provisional application No. 60/629,445, filed on Nov. 19, 2004.

(51) Int. Cl.
*B05D 1/06* (2006.01)
*B05D 1/12* (2006.01)

(52) U.S. Cl. ..... 427/470; 427/202

(58) Field of Classification Search ..... None
See application file for complete search history.

(56) References Cited

U.S. PATENT DOCUMENTS

| | | | | |
|---|---|---|---|---|
| 3,065,205 A | | 11/1962 | Bonner | |
| 3,441,538 A | | 4/1969 | Marks | |
| 3,442,857 A | | 5/1969 | Thornton | |
| 4,287,112 A | | 9/1981 | Berghmans | |
| 4,380,618 A | | 4/1983 | Khan et al. | |
| 4,578,427 A | | 3/1986 | Saito et al. | |
| 4,897,439 A | | 1/1990 | Rau et al. | |
| 5,093,403 A | | 3/1992 | Rau et al. | |
| 5,131,827 A | | 7/1992 | Tasaka | |
| 5,240,775 A | * | 8/1993 | Tannenbaum | 428/422 |
| 5,357,040 A | | 10/1994 | McGrath et al. | |
| 5,536,583 A | | 7/1996 | Roberts et al. | |
| 5,670,010 A | | 9/1997 | Hagiwara et al. | |
| 5,922,468 A | * | 7/1999 | Huesmann et al. | 428/422 |
| 6,232,372 B1 | | 5/2001 | Brothers et al. | |
| 6,518,349 B1 | | 2/2003 | Felix et al. | |
| 2008/0187667 A1 | * | 8/2008 | Hennessey | 427/299 |

FOREIGN PATENT DOCUMENTS

| | | |
|---|---|---|
| JP | 60058456 | 4/1985 |
| WO | WO 2005/119375 A1 | 12/2005 |

* cited by examiner

*Primary Examiner*—Frederick J Parker

(57) ABSTRACT

The invention relates to use of a tetrafluoroethylene/perfluoroolefin copolymer applied as a primer powder in conjunction with a powder overcoat of tetrafluoroethylene/perfluoro (vinyl alkyl ether) copolymer, also known as perfluoroalkoxy polymer (PFA), which when baked onto a substrate gives superior and more durable adhesion of the coating system to the substrate. The quality of the adhesion is measured by a boiling water peel test.

21 Claims, No Drawings

PROCESS FOR APPLYING FLUOROPOLYMER POWDER COATING AS A PRIMER LAYER AND AN OVERCOAT

FIELD OF THE INVENTION

This invention is in the field of forming a durable release surface by applying a primer powder to a substrate to form a fluoropolymer primer layer thereon, and applying a fluoropolymer powder on the primer layer to form an overcoat. In particular, the invention is directed to the selection of a fluoropolymer primer powder that achieves good intercoat adhesion with a tetrafluoroethylene/perfluoroalkyl (vinyl ether) copolymer powder overcoat and maintains a long lasting bond with the substrate.

BACKGROUND OF THE INVENTION

Fluoropolymer resins having properties such as good chemical resistance, excellent release, good heat resistance and electrical insulation are desirable in a number of applications. Fluoropolymer powders which are melt-flowable have been found useful in coating cookware articles such rice cookers, grills and bakeware, as well as numerous industrial applications such as fuser rolls or belts for copiers and printers, and chemical processing reactors. One of the advantages of applying powder coatings in lieu of liquid coatings is that the drying and venting steps used in applying liquid coatings, as well as the equipment associated with applying liquid coatings, are eliminated. In addition, powder coatings do not require the use of volatile organic solvents that present environmental concerns and necessitate expensive remediation procedures.

Powder coatings for both a primer layer and an overcoat is described in U.S. Pat. No. 5,093,403 to Rau et al. In this patent, perfluoroalkoxy polymer (PFA) is exemplified for both the primer layer and the overcoat. This patent recognizes that it is difficult to bond PFA resin to metal substrates, and that PFA must be applied at relatively high temperatures—i.e., in the range of about 675° to about 720° F. (357° to 382° C.). Rau et al. disclose the use of binders such as poly(phenylene sulfide) (PPS) to achieve bonding of the PFA resin to the metal substrate at these elevated temperatures without any significant deterioration (degradation) to the PFA.

Because of its high service temperature, good abrasion resistance and excellent release properties, PFA is the resin of choice for surfaces used in rigorous commercial applications such as for release surfaces for commercial bakeware. Commercial bake pans undergo numerous high temperature cycles each day and must retain their release properties for a significant length of time to make commercial production of baked goods economical. However, experience has shown that the application of a PFA overcoat on a PFA primer layer results in inadequate adhesion of the system over time. As a result, a PFA/PFA system as disclosed in Rau et al. may fail too quickly and inadequately addresses the needs of a commercial operation that subjects substrates with release surfaces to thousands of bake cycles per year.

Thus, there remains a need for an improved powder primer composition that can be used with a PFA topcoat that will permit a primer/topcoat system that can be used at high service temperatures with improved adhesion and longer life while maintaining good release properties and abrasion resistance.

SUMMARY OF THE INVENTION

Surprisingly, it has been found that the use of a tetrafluoroethylene/perfluoroolefin copolymer applied as a primer powder in conjunction with a powder overcoat of tetrafluoroethylen/perfluoro (vinyl alkyl ether) copolymer, also known as perfluoroalkoxy polymer (PFA), when baked onto a substrate gives superior and more durable adhesion of the coating system to the substrate. The quality of the adhesion is measured by a boiling water peel test.

Moreover, the system of the present invention, which uses PFA in the overcoat, takes advantage of the known good release properties, abrasion resistance and high service temperature of PFA in this layer.

Therefore, the present invention provides a process for forming a release surface on a substrate, comprising (a) applying a primer powder to the substrate to form a primer layer thereon, (b) applying an overcoat powder on the primer layer to form an overcoat layer on the primer layer, the primer containing a tetrafluoroethylene/perfluoroolefin copolymer and polymer binder and the overcoat containing tetrafluoroethylene/perfluoro(alkyl vinyl ether) copolymer (c) baking the primer layer and the overcoat layer to form the release surface. The powder layers are preferably applied by electrostatic spraying. The polymer binder is preferably selected from a group consisting of polyether sulfones, polyphenylene sulfides, and polyaryleneetherketones. In one embodiment, the primer powder containing tetrafluoroethylene/perfluoroolefin copolymer further contains tetrafluoroethylene/perfluoro(alkyl vinyl ether) copolymer.

DETAILED DESCRIPTION OF THE PREFERRED EMBODIMENTS

In accordance with the present invention, there is provided a process for forming a release surface on a substrate. The process comprises the steps of applying a primer powder containing tetrafluoroethylene/perfluoroolefin copolymer and polymer binder to the substrate to form a primer layer thereon and applying a powder overcoat containing tetrafluoroethylene/perfluoro(alkyl vinyl ether) copolymer on the primer layer to form an overcoat layer thereon. The primer layer and the overcoat layer are baked to form the release surface on the substrate.

Fluoropolymers

The fluoropolymers used both in the primer and in the overcoat of this invention are melt-flowable. Typically, the melt viscosities will range from $10^2$ Pa·s to about $10^6$ Pa·s, preferably $10^3$ to about $10^5$ Pa·s measured at 372° C. by the method of ASTM D-1238 modified as described in U.S. Pat. No. 4,380,618, and ASTM D-2116 or D-3307 depending on the copolymer. Examples of such melt-flowable fluoropolymers include copolymers of tetrafluoroethylene (TFE) and at least one fluorinated copolymerizable monomer (comonomer) present in the polymer in sufficient amount to reduce the melting point of the copolymer substantially below that of TFE homopolymer, polytetrafluoroethylene (PTFE), e.g., to a melting temperature no greater than 315° C.

The primer powder used in the invention comprises a copolymer of tetrafluoroethylene (TFE) and perfluoroolefin, the perfluoroolefin comonomer preferably having 3 to 8 carbon atoms, such as hexafluoropropylene (HFP). In one embodiment, the primer powder comprising a copolymer of tetrafluoroethylene (TFE) and perfluoroolefin, further comprises up to 60 wt % of a copolymer of tetrafluoroethylene and perfluoro(alkyl vinyl ether) (PAVE) in which the linear or branched alkyl group preferably contains 1 to 5 carbon atoms.

The overcoat powder comprises a copolymer of tetrafluoroethylene and perfluoro(alkyl vinyl ether) (PAVE) in which the linear or branched alkyl group preferably contains 1 to 5 carbon atoms. Preferred PAVE monomers are those in which the alkyl group contains 1, 2, 3 or 4 carbon atoms, and the copolymer can be made using several PAVE monomers. Preferred TFE copolymers include PFA (TFE/PAVE copolymer), TFE/HFP/PAVE wherein PAVE is PEVE and/or PPVE and MFA (TFE/PMVE/PAVE wherein the alkyl group of PAVE has at least two carbon atoms).

The melting points of TFE/perfluoroolefin copolymers in the primer are typically below those of the TFE/PAVE copolymers of the overcoat powder. For instance the melting point of TFE/HFP, also known as FEP, is typically about 510° F. (266° C.) and below the melting point of TFE/PPVE which is typically about 590° F. (310° C.). Thus it is surprising that the primer layer containing a lower melting point TFE/perfluoroolefin copolymer forms a superior and durable coating system with a higher melting TFE/PAVE (PFA) copolymer overcoat. One might have expected that a primer system with a lower melting fluoropolymer could not withstand high curing or baking temperatures, typically 675°(357° C.) to 720° F. (382° C.), used with PFA systems and that the lower melting copolymer would degrade (bubble) and cause delamination from the substrate. Surprisingly it has been found that the TFE/perfluoroolefin primer powder layer in conjunction with the PFA powder overcoat forms a coating system that when baked is superior in adhesion to PFA primer/PFA overcoat systems of the prior art.

Polymer Binder

The primer powder coating used in the present invention further contains in addition to the tetrafluoroethylene/perfluoroolefin copolymer, a high temperature resistant polymer binder, 5 to 90 wt. % polymer binder based on the combined weight of the fluoropolymer(s) and the polymer binder. The binder component comprises a polymer that is film-forming upon heating to fusion, is thermally stable, and has a high sustained temperature use. A binder is well known for use in nonstick finishes for adhering fluoropolymer to substrates and for film-forming. The binder is generally non-fluorine containing and yet adheres to the fluoropolymer. Preferred polymer binders used in this invention include one or more: (1) polyethersulfones (PES), which are amorphous thermoplastic polymers with a glass transition temperature of about 230° C. and a sustained temperature service of about 170° C. to 190° C., (2) polyphenylene sulfides (PPS), which are partially crystalline polymers with a melting temperature of about 280° C. and a sustained temperature service of about 200° C. to 240° C., and (3) polyaryleneetherketone, such as polyetherketoneketone (PEKK), polyetheretherketone (PEEK), and polyetherketone (PEK). Polyaryleneetherketone are thermally stable at least 250° C. and melt at temperatures of at least 300° C. and are and are disclosed in one or more of the following U.S. Pat. Nos. 3,065,205, 3,441,538, 3,442,857, 5,357,040, 5,131,827, 4,578,427. All of the polymer binders listed above are thermally stable and dimensionally stable at temperatures within their sustained service range and below, and they are wear resistant. These polymers also adhere well to clean metal surfaces.

Other Additives

In addition to the fluoropolymer, the powder primer and powder overcoat may contain inorganic fillers, film hardeners, pigments, stabilizers and other additives. Examples of suitable fillers and film hardeners include inorganic oxides, nitrides, borides and carbides of silicon, zirconium, tantalum, titanium, tungsten, boron, and aluminum as well as glass flake, glass bead, glass fiber, aluminum or zirconium silicate, mica, metal flake, metal fiber, fine ceramic powders, silicon dioxide, titanium dioxide, barium sulfate, talc, carbon black, etc. and synthetic fibers of polyamides, polyesters, and polyimides. In one embodiment, the powder primer contains 10 to 20 wt % of inorganic filler based on the combined weight of the fluoropolymer(s), polymer binder, and filler.

Primer Powder Preparation

The powder primer containing tetrafluoroethylene/perfluoroolefin copolymer and polymer binder and optionally other fluoropolymers and other additives as discussed above may be made using conventional mechanical methods of blending powders of individual components.

Alternately, multicomponent particles of powder primer i.e., tetrafluoroethylene/perfluoroolefin copolymer and polymer binder with optionally other fluropolymer, can be made according to the teaching of Brothers et al. U.S. Pat. No. 6,232,372 by combining fluoropolymer particles and other components with a solution of polymer binder, mixing the fluoropolymer with the solution of polymer binder and isolating a composition of multicomponent particles of the fluoropolymer with non-dispersed polymer binder. By "non-dispersed polymer binder" is meant that the multicomponent relationship of the particles of the primer power is not one in which the polymer binder component is dispersed in the fluoropolymer component. Thus the polymer binder component used in one embodiment of the invention is not in the form of filler dispersed in fluoropolymer component, but rather exists as a coating surrounding the fluorpolymer particles. Non-dispersed polymer binder being present at the surface of the multicomponent particles of this embodiment promotes adherence of the particles to a substrate when the composition is used as a primer coating.

In a more preferred embodiment, the primer powder can be made into a sprayable powder according to the teachings of Felix et al. in U.S. Pat. No. 6,518,349 by spray drying a liquid dispersion of primary particles of tetrafluoroethylene/perfluoroolefin copolymer together with polymer binder, and optionally other components as discussed above, to produce friable granules of agglomerated particles of tetrafluoroethylene/perfluoroolefin copolymer and polymer binder. By "friable" is meant that the granules can be reduced to a smaller particle size (comminuted) without causing appreciable particle deformation such as the formation of fibrils extending from the ground particles. Blends of polymers and components formed by the spray dried method are more uniform than those formed by conventional mechanical methods of blending powders of individual components after powder formation. Multicomponent powders formed by spray drying do not segregate during electrostatic application thereby providing more uniform coatings on substrates.

The fluoropolymer component used in spray drying is generally commercially available as a dispersion of the polymer in water, which is the preferred form for the composition of the invention for ease of application and environmental acceptability. By "dispersion" is meant that the fluoropolymer particles are stably dispersed in the aqueous medium, so that settling of the particles does not occur within the time when the dispersion will be used; this is achieved by the small size of the fluoropolymer particles (also referred to as primary particles), typically on the order of 0.2 micrometers, and the use of surfactant in the aqueous dispersion by the dispersion manufacturer. Such dispersions can be obtained directly by the process known as dispersion polymerization, optionally followed by concentration and/or further addition of surfactant.

Application of the Powders

The primer powder and overcoat powder can be applied to substrates by suspending the dried powder in a suitable liquid with suitable surfactants or viscosity modifiers as desired and depositing the composition by a wet coating technique. Preferably, the powder coating used in this invention are deposited in the dried form by well known conventional techniques, e.g., hot flocking, electrostatic spraying, electrostatic fluidized bed, rotolining and the like. Preferred is electrostatic spraying such as triboelectric spraying or corona spraying.

Primer powders are typically applied to cleaned and degreased substrates which have preferably been treated by conventional treatment such as grit blasting, etching, or chemical treatment, in order to aid adhesion of the coating to the substrate. While any suitable substrate can be coated, examples of typical metal substrates include steel, high carbon steel, stainless steel, aluminized steel and aluminum, among others. The process of applying powder primer and overcoat primer to the substrate is preferably when the substrate is at a temperature of 15 to 25° C.

The powder overcoat may be applied to the substrate over the powder primer without first baking the powder primer in what is termed a single bake application, i.e., the baking of the overcoat typically bakes the primer layer. In the single bake system, the coated substrate is typically baked for 60 minutes at about 735° F. (390° C.). Alternately, the powder overcoat can be applied and baked after the primer layer is baked in what is referred to as a double bake application. Typically, the powder primer is applied to the substrate and baked at 725° F. (385° C.) for about 30 minutes with subsequent application of the overcoat powder which then baked for about another 30 minutes at 725° F. (385° C.). In typical applications, the primer layer is less than about 2 mils (50 micrometers) thick and the overcoat layer is no greater than about 25 mils (650 micrometers). In other applications, the primer layer is less than about 1.5 mils thick (38 micrometers); the overcoat layer is between about 1.5 to about 3 mils thick (38 micrometers to 76 micrometers).

Powder coatings as described above are used as the primer layer and the overcoat layer for the release surface on a substrate of the present invention. Such coatings have application to cookware and bakeware as well as to numerous industrial applications such as fuser rolls or belts for copiers and printers, valves, tanks, impellers, pipes, metal foil, shoe molds, snow shovels and plows, ship bottoms, chutes, conveyors, dies, tools, industrial containers, molds, lined reactor vessels, automotive panels, heat exchangers, tubing, and the like.

Test Method

Bond Strength Adhesion Test

Aluminum panels 4.0"×12.0" (10.1 cm×30.5 cm) panels are cleaned with an acetone rinse. The panel has a grit blast surface. The panels are coated according to the description in each of the examples. The panels are subjected to a bond strength adhesion test as detailed below.

Bond strength of coated metal panels is determined by subjecting the coated substrate to a simplified T-peel test (Peel Resistance of Adhesives). The baked coating is cut through to the metal substrate with parallel lines one inch apart. A one inch wide chisel is used to pry up a flap of coating that is sufficient to hold on to. The coating is pulled from the substrate by hand, or alternately with a pair of pliers.

Bond strength is rated before and after a boiling water test. For the boiling water test the panel is immersed in boiling water for a predetermined time. Bond failures are rated qualitatively with a rating system of 1 through 4 with a rating of 4 being the best adhesion rating. A rating of 1 is given to samples demonstrating an adhesive failure that resulted in the film peeling very easily. A rating of 2 is given to samples which exhibited an adhesive failure that required significant effort to peel the film. A rating of 3 is given to samples which failed by peeling, but resulted in significant elongation of the film or elongation of the film followed by gradual tearing of the film. A rating of 4 is given to samples which demonstrated a clean coating break or elongation followed by a break.

EXAMPLES

In the following Examples, aluminum panel substrates approximately 4"×12" are cleaned with acetone and grit blasted with 100 grit aluminum oxide) to a roughness of approximately 70-125 microinches Ra using Pro-Finish blast cabinet, Model PF-3648 available from Empire Abrasive Equipment Company.

Powder coatings are applied to the substrates using a Nordsen Sure-Coat electrostatic powder coating gun. Coated panels are baked in a electrically heated hot air convection oven with the times and temperatures specified in the examples. The ovens used for these examples are Class A solvent venting ovens.

For the examples where primer powder is prepared from tetrafluoroethylene/perfluoroolefin copolymer and polymer binder by spray drying, the spray dryer used is a APV Pilot Spray Dryer type PSD52, manufactured by APV Anhydro AS, Copenhagen, Denmark. The spray dryer is operated with an inlet air temperature of 300° C. to 320° C. and an outlet temperature of 110° C. to 125° C. Powder is collected in a cyclone separator, fines are collected in a final filter and hot air and water vapor is exhausted. The dispersion is pumped using a peristalic pump and sprayed with a two fluid (air and liquid) nozzle. Air pressure on the nozzle is 60 psig.

Fluoropolymers

Unless otherwise stated in the following examples, dispersion concentrations are in wt % based on the combined weights of solids and liquids. The solids contents of dispersions are determined gravimetrically and are stated in wt % based on the combined weights of solids and liquids.

Melt flow rate at measured at 372° C. by the method of ASTM (D-2116 or D-3307). MFR is related to melt viscosity (MV) by the relationship MV=53.15/MFR, when MFR is in units of g/10 min and MV is in units of $10^3$ Pa·s.

Raw dispersion particle size (RDPS) is measured by photon correlation spectroscopy.

Average particle size of powder particles was measured by laser light scattering on dry particles, (using the Microtrac 101 Laser Particle Counter, available from Leeds & Northrup, a division of Honeywell Corporation).

FEP dispersion: TFE/HFP copolymer resin dispersion in water with a solids content of from 28-32 wt. % and raw dispersion particle size (RDPS) of from 160-220 nanometers, the resin having a HFP content of from 10.3-13.2 wt. %, and a melt flow rate of from 2.95-13.3. The melting point of the resin is 507° F. (264° C.).

PFA dispersion: TFE/PPVE copolymer resin dispersion in water with a solids content of from 28-32 wt. % and raw dispersion particle size (RDPS) of from 150-245 nanometers, the resin having a PPVE content of from 2.9-3.6 wt. % and a melt flow rate of from 1.3-2.2. The melting point of the resin is 590° F. (310° C.).

FEP powder (product code 532-8110 commercially available from the DuPont Company): TFE/HFP copolymer powder containing 10.3-13.2% HFP, a particle size in the range of 26.3-46.6 microns and a melt flow rate of 2.95-13.3 g/10 min, bulk density 48-72 g/100 cc. The melting point of the resin is 507° F. (264° C.).

PFA powder (type 350, product code 532-7410 commercially available from the DuPont Company): TFE/PPVE fluoropolymer powder containing 2.9-3.6% PPVE, a particle size in the range of 28.5-0.9 microns and a melt flow rate of 1.3-2.2 g/10 min, bulk density 56-87 g/100 cc. The melting point of the resin is 590° F. (310° C.).

Polymer Binders

Polyphenylene sulfide (PPS) commercially available as Ryton PR11-10 from Chevron Phillips Chemical Company.

Polyethylene sulfone (PES) commercially available as Sumika Excel PES 4100 mp from Sumitomo Chemical.

Polyetheretherketone (PEEK) commercially available as 150 PF grade from Victrex.

Other Components

Mica commercially available as grades of Afflair from EMD Chemicals.

Silwet L-77 surfactant commercially available from GE Silicones

Black pigment commercially available as C.I. pigment black 28 from Engelhard Corporation

Comparative Example 1

PFA/PPS Primer Powder Mechanically Blended

Mechanically blended primer powder is made by placing PPS binder and PFA powder, DuPont 532-7410, into a plastic bottle and rolling for 15 minutes according to the proportions listed in Table 1. The powder is applied by electrostatic spraying onto a grit blasted aluminum panel as prepared above. PFA overcoat powder, DuPont 532-7410, is electrostatically applied on top of the primer powder coating to form the overcoat layer. The panel is placed into a 735° F. (390° C.) oven and baked for one hour in a single bake operation. Final coating thickness is 2.8 mils having a primer thickness of about 1 mil (25.4 micrometers) and an overcoat thickness of about 1.8 mils (45.7 micrometers). The adhesive strength of the bond of the coating to the substrate is tested using the peel test described above and results are presented in Table 1.

In general, the baked coating resists peeling prior to boiling, however, after the panel is placed in boiling water for 14 hours, the coating peels from the substrate. Therefore, testing shows evidence of a poor, non-durable bond.

TABLE 1

Table 1 - PFA/PPS Mechanical Blend

| Sample | % PPS | % PFA | Before Boiling | After Boiling 14 hours |
|---|---|---|---|---|
| 1 | 90 | 10 | 1 | 1 |
| 2 | 70 | 30 | 2 | 2 |

TABLE 1-continued

Table 1 - PFA/PPS Mechanical Blend

| Sample | % PPS | % PFA | Before Boiling | After Boiling 14 hours |
|---|---|---|---|---|
| 3 | 30 | 70 | 2 | 2 |
| 4 | 10 | 90 | 2 | 2 |

Example 1

FEP/PPS Primer Powder—Mechanically Blended

Mechanically blended primer powder is made by placing PPS binder and FEP powder, DuPont 532-8110, into a plastic bottle and rolling for 15 minutes according to the proportions listed in Table 2. The powder is applied by electrostatic spraying onto grit blasted aluminum panels as prepared above. PFA overcoat powder, DuPont 532-7410, is applied by electrostatic spraying on top of the primer powder coating to form the overcoat layer. The panel is placed into a 735° F. (390° C.) oven and baked for one hour in a single bake operation. Final coating thickness is 2.8 mils having a primer thickness of about 1 mil (25.4 micrometers) and an overcoat thickness of about 1.8 mils (45.7 micrometers). The adhesive strength of the bond of the coating to the substrate is tested using the peel test described above and results are presented in Table 2.

In general, the baked coating resists peeling both prior to boiling and after boiling for 14 hours, evidence of a strong, durable bond.

TABLE 2

FEP/PPS Mechanical Blend

| | % PPS | % FEP | Before Boiling | After Boiling 14 hours |
|---|---|---|---|---|
| 5 | 90 | 10 | 4 | 4 |
| 6 | 70 | 30 | 4 | 4 |
| 7 | 30 | 70 | 4 | 4 |
| 8 | 10 | 90 | 4 | 4 |

Example 2

FEP/PFA/PPS Primer Powder—Mechanically Blended

Mechanically blended primer powder is made by placing PPS binder, FEP powder (DuPont 532-8110), and PFA powder (DuPont 532-7410) into a plastic bottle and rolling for 15 minutes according to the proportions listed in Table 3. The powder is applied by electrostatic spraying onto grit blasted aluminum panels as prepared above. PFA overcoat powder, DuPont 532-7410, is applied by electrostatic spraying on top of the primer powder coating to form the overcoat layer. The panel is placed into a 735° F. (390° C.) oven and baked for one hour in a single bake operation. Final coating thickness is 2.8 mils having a primer thickness of about 1 mil (25.4 micrometers) and an overcoat thickness of about 1.8 mils (45.7 micrometers). The adhesive strength of the bond of the coating to the substrate is tested using the peel test described above and results are presented in Table 3.

In general, the baked coating resists peeling both prior to boiling and after.

TABLE 3

| FEP/PFA/PPS Mechanical Blend | | | | | |
|---|---|---|---|---|---|
| | % PPS | % FEP | % PFA | Before Boiling | After Boiling 14 hours |
| 9 | 50 | 5 | 45 | 4 | 4 |
| 10 | 50 | 40 | 10 | 4 | 4 |
| 11 | 34 | 33 | 33 | 4 | 4 |

Comparative Example 2

PFA/PPS Primer Powder—Spray Dried

PFA/PPS primer powder is prepared using spray drying. Deionized water, surfactant (Silwet L-77), and PPS in amounts as shown in Table 4a are first mixed with a high shear mixing blade. After five minutes of mixing, the mixer is turned off and PFA dispersion is stirred in using low shear mixing. An APV pilot size spray dryer is turned on and preheated to 300° C. inlet air temperature and DI water is fed to the sprayer to maintain an outlet temperature of 115° C. The feed to the spray dryer is changed from DI water to the PFA mixture. Pump speed for the mixture is adjusted to keep the outlet temperature of the sprayer at 115° C. In the spray dryer the water is evaporated in the hot air stream and the resulting powder is collected through a cyclone separator. The composition of the primer powder particles is presented in Table 4b.

The primer powder is applied by electrostatic spraying onto grit blasted aluminum panel as prepared above. PFA overcoat powder, DuPont 532-7410, is applied by electrostatic spraying on top of the primer powder coating to form the overcoat layer. The panel is placed into a 735° F. (390° C.) oven and baked for one hour in a single bake operation. Final coating thickness is 2.8 mils having a primer thickness of about 1 mil (25.4 micrometers) and an overcoat thickness of about 1.8 mils (45.7 micrometers). The adhesive strength of the bond of the coating to the substrate is tested using the peel test described above and results are presented in Table 4b.

In general, the baked coating resists peeling prior to boiling, however, after the panel is placed in boiling water for 14 hours, the coating peels from the substrate. Therefore, testing shows evidence of a poor, non-durable bond.

TABLE 4a

| Sample | PPS Weight (g) | PFA Weight (g) | Weight DI H2O (g) | Total weight (g) | Surfactant |
|---|---|---|---|---|---|
| 12 | 180.0 | 66.7 | 753.3 | 1000.0 | 1.0 |
| 13 | 140.0 | 200.0 | 660.0 | 1000.0 | 1.0 |
| 14 | 60.0 | 466.7 | 473.3 | 1000.0 | 1.0 |
| 15 | 20.0 | 600.0 | 380.0 | 1000.0 | 1.0 |

TABLE 4b

| PFA/PPS Spray Dried | | | | |
|---|---|---|---|---|
| Sample | % PPS | % PFA | Before Boiling | After Boiling 14 hours |
| 12 | 90 | 10 | 3 | 1 |
| 13 | 70 | 30 | 4 | 2.5 |

TABLE 4b-continued

| PFA/PPS Spray Dried | | | | |
|---|---|---|---|---|
| Sample | % PPS | % PFA | Before Boiling | After Boiling 14 hours |
| 14 | 30 | 70 | 4 | 2.5 |
| 15 | 10 | 90 | 2B | 1 |

Example 3

FEP/PPS Primer Powder—Spray Dried

FEP/PPS primer powder is prepared for the primer layer using spray drying. Deionized water, surfactant (Silwet L-77), and PPS in amounts as shown in Table 5a are mixed with a high shear mixing blade. After five minutes of mixing, the mixer is turned off and FEP dispersion is stirred in using low shear mixing. An APV pilot size spray dryer is turned on and preheated to 300° C. inlet air temperature and Dl water is fed to the sprayer to maintain an outlet temperature of 115° C. The feed to the spray dryer is changed from Dl water to the FEP mixture. Pump speed for the mixture is adjusted to keep the outlet temperature of the sprayer at 115° C. In the spray dryer the water is evaporated in the hot air stream and the resulting powder is collected through a cyclone separator. Average particle size of the collected powder is 25 microns. The composition of the primer powder particles is presented in Table 5b.

The primer powder is applied by electrostatic spraying onto grit blasted aluminum panels. PFA powder, DuPont 532-7410, is powder coated on top of the primer layer. The panel is placed into a 735° F. (390° C.) oven and baked for one hour. Final coating thickness is 2.8 mils having a primer thickness of about 1 mil (25.4 micrometers) and an overcoat thickness of about 1.8 mils (45.7 micrometers). The adhesive strength of the bond of the coating to the substrate is tested using the peel test described above and results are presented in Table 5b.

In general, the baked coating resists peeling both prior to boiling and after boiling for 14 hours, evidence of a strong, durable bond.

TABLE 5a

| Sample | FEP Weight (g) | PPS Weight (g) | DI H2O Weight (g) | Total Weight (g) | Surfactant |
|---|---|---|---|---|---|
| 16 | 328.2 | 100.0 | 571.8 | 1000.0 | 1.0 |
| 17 | 459.5 | 60.0 | 480.5 | 1000.0 | 1.0 |
| 18 | 590.7 | 20.0 | 389.3 | 1000.0 | 1.0 |

TABLE 5b

| FEP/PPS Spray Dried | | | | |
|---|---|---|---|---|
| Sample | % PPS | % FEP | Before Boiling | After Boiling 14 hours |
| 16 | 50 | 50 | 4 | 4 |
| 17 | 30 | 70 | 4 | 4 |
| 18 | 10 | 90 | 4 | 4 |

Example 4

FEP/PFA/PPS Primer Powder—Spray Dried

The procedure of Example 3 is followed with PFA/FEP/PPS primer power. De-ionized water, surfactant (Silwet L-77), PPS in amounts as shown in Table 6a are first mixed with a high shear mixing blade. After high shear mixing, FEP dispersion and PFA dispersion are stirred into the mixture and spray dried. Average particle size of the collected powder is 22 microns. The composition of the primer powder particles is presented in Table 6b.

The primer powder is applied by electrostatic spraying onto grit blasted aluminum panels. PFA powder, DuPont 532-7410, is powder coated on top of the primer layer. The panel is placed into a 735° F. (390° C.) oven and baked for one hour. Final coating thickness is 2.8 mils having a primer thickness of about 1 mil (25.4 micrometers) and an overcoat thickness of about 1.8 mils. The adhesive strength of the bond of the coating to the substrate is tested using the peel test described above and results are presented in Table 6b.

In general, the baked coating resists peeling both prior to boiling and after boiling for 14 hours, evidence of a strong, durable bond.

TABLE 6a

| Sample | FEP Weight (g) | PPS Weight (g) | PFA Weight (g) | DI H2O Weight (g) | Total Weight (g) | Surfactant |
|---|---|---|---|---|---|---|
| 19 | 32.8 | 100.0 | 300.0 | 567.2 | 1000.0 | 1.0 |
| 20 | 65.6 | 100.0 | 266.7 | 567.7 | 1000.0 | 1.0 |
| 21 | 131.3 | 100.0 | 200.0 | 568.7 | 1000.0 | 1.0 |
| 22 | 196.9 | 100.0 | 133.3 | 569.8 | 1000.0 | 1.0 |
| 23 | 262.6 | 100.0 | 66.7 | 570.8 | 1000.0 | 1.0 |
| 24 | 216.6 | 68.0 | 220.0 | 495.4 | 1000.0 | 1.0 |

TABLE 6b

FEP/PFA/PPS Spray Dried

| Sample | % PPS | % FEP | % PFA | Before Boiling | After Boiling 14 hours |
|---|---|---|---|---|---|
| 19 | 50 | 5 | 45 | 4 | 4 |
| 20 | 50 | 10 | 40 | 4 | 4 |
| 21 | 50 | 20 | 30 | 4 | 4 |
| 22 | 50 | 30 | 20 | 4 | 4 |
| 23 | 50 | 40 | 10 | 4 | 4 |
| 24 | 34 | 33 | 33 | 4 | 4 |

Example 5

Commercial Simulation, Bakery Test

The procedure of Example 3 is followed to form FEP/PPS primer powder except that the primer powder additionally has pigments and fillers The primer powder is made with 3266 g de-ionized water, 9.9 g surfactant (Silwet L-77), 460 g PPS, 85 g barium sulfate, 65 g Afflair 520 (mica) and 40 g black pigment. After high shear mixing, 1084 g of FEP dispersion is stirred in. The composition of the primer powder is 46% PPS, 3.5% FEP, 8.5% barium sulfate, 6.5% Afflair (mica), 4% black pigment.

The powder primer is applied by electrostatic spraying onto grit blasted aluminized steel bun pans, approximately 2 ft.×3 ft. which have been cleaned and grit blast by the procedures outlined above. The pans having depressions to accommodate for the baking of hamburger buns. PFA powder, DuPont 532-7410, is powder coated on top of the primer layer. The bun pans are placed into a 735° F. (390° C.) oven and baked for 1 hour. Final coating thickness is 2.8 mils having a primer thickness of about 1 mil (25.4 micrometers) and an overcoat thickness of about 1.8 mils (45.7 micrometers). Pigment and fillers give the coating good hiding of the substrate and a uniform appearance.

The adhesive strength of the bond of the coating to the substrate is tested using the peel test described above. The baked coating resists peeling both prior to boiling and after boiling for 14 hours, evidenced by a bond strength rating of indicating a strong, durable bond.

The bun pans prepared in this manner are subjected to a simulated commercial application in a bakery test. For 4 cycles a day, raw dough is placed in the depressions of the bun pan, the pans are placed in a baking oven and the temperature of the oven is ramped to 450° F. (232° C.) for a 20 minute bake cycle to produce hamburger buns. After 6 months and 1500 cycles, there is no evidence of bond failure of the coating to the bun pan substrate.

Example 6

FEP/PES Primer Powder—Spray Dried

The procedure of Example 3 is followed to form FEP/PES primer powder. De-ionized water, surfactant (Silwet L-77), PES are first mixed with a high shear mixing blade in the amounts shown in Table 7a. After high shear mixing, FEP dispersion is stirred into the mixture and spray dried. Average particle size of the collected powder is 15 microns. The composition of the primer powder particles is presented in Table 7b.

The primer powder is applied by electrostatic spraying onto grit blasted aluminum panels. PFA powder, DuPont 532-7410, is powder coated on top of the primer layer. The panel is placed into a 735° F. (390° C.) oven and baked for one hour. Final coating thickness is 2.8 mils having a primer thickness of about 1 mil (25.4 micrometers) and an overcoat thickness of about 1.8 mils (45.7 micrometers). The adhesive strength of the bond of the coating to the substrate is tested using the peel test described above.

The bond strength of the coating system is 4 both prior to boiling and after boiling for 14 hours, evidence of a strong, durable bond.

TABLE 7a

| Sample | FEP Weight (g) | PES Weight (g) | DI H2O Weight (g) | Total Weight (g) | Surfactant |
|---|---|---|---|---|---|
| 25 | 310 | 100 | 590 | 1000 | 2 |

TABLE 7b

FEP/PES Spray Dried

| Sample | % PES | % FEP | Before Boiling | After Boiling 14 hours |
|---|---|---|---|---|
| 25 | 50 | 50 | 4 | 4 |

Example 7

FEP/PEEK Primer Powder—Spray Dried

The procedure of Example 3 is followed to form FEP/PEEK primer powder. De-ionized water, surfactant (Silwet L-77), PEEK are first mixed with a high shear mixing blade in the amounts shown in Table 8a. After high shear mixing, FEP dispersion is stirred into the mixture and spray dried. Average particle size of the collected powder is 19 microns. The composition of the primer powder particles is presented in Table 8b.

The primer powder is applied by electrostatic spraying onto grit blasted aluminum panels. PFA powder, DuPont 532-7410, is powder coated on top of the primer layer. The panel is placed into a 735° F. (390° C.) oven and baked for one hour. Final coating thickness is 2.8 mils having a primer thickness of about 1 mil (25.4 micrometers) and an overcoat thickness of about 1.8 mils (45.7 micrometers). The adhesive strength of the bond of the coating to the substrate is tested using the peel test described above.

The bond strength of the coating system is 4 both prior to boiling and after boiling for 14 hours, evidence of a strong, durable bond.

TABLE 8a

| Sample | FEP Weight (g) | PEEK Weight (g) | DI H2O Weight (g) | Total Weight (g) | Surfactant |
|---|---|---|---|---|---|
| 26 | 186 | 140 | 674 | 1000 | 2 |

TABLE 8b

| FEP/PEEK Spray Dried | | | | |
|---|---|---|---|---|
| Sample | % PEEK | % FEP | Before Boiling | After Boiling 14 hours |
| 26 | 70 | 30 | 4 | 4 |

What is claimed is:

1. A process for forming a release surface on a substrate, comprising (a) applying a primer powder to said substrate to form a primer layer thereon, (b) applying an overcoat powder on said primer layer to form an overcoat layer on said primer layer, said primer containing a tetrafluoroethylene/perfluoroolefin copolymer and polymer binder and said overcoat containing tetrafluoroethylene/perfluoro(alkyl vinyl ether) copolymer (c) baking said primer layer and said overcoat layer to form said release surface.

2. The process of claim 1 wherein said perfluoroolefin contains 3 to 8 carbon atoms.

3. The process of claim 2 wherein said perfluoroolefin is hexafluoropropylene.

4. The process of claim 1 in which the alkyl group of said perfluoro(alkyl vinyl ether) contains 1 to 5 carbon atoms.

5. The process of claim 1 in which said perfluoro(alkyl vinyl ether) is perfluoro(propyl vinyl ether).

6. The process of claim 1 in which the said primer powder is applied by electrostatic spraying.

7. The process of claim 1 in which the said overcoat powder is applied by electrostatic spraying.

8. The process of claim 1 wherein said polymer binder is selected from the group consisting of polyether sulfones, polyphenylene sulfides, and polyaryleneetherketones.

9. The process of claim 2 wherein said polymer binder comprises polyphenylene sulfide.

10. The process of claim 2 wherein said primer powder further comprises up to 60 wt % of tetrafluoroethylene/perfluoro(alkyl vinyl ether).

11. The process of claim 1 wherein said primer powder contains 5 to 90 wt % polymer binder based on the combined weight of said fluoropolymer and said polymer binder.

12. The process of claim 1 wherein said primer contains 10 to 20 wt % of inorganic filler based on the combined weight of said fluoropolymer, polymer binder, and filler.

13. The process of claim 1 wherein the powder of said primer powder contains particles containing both said fluoropolymer and said polymer binder.

14. The process of claim 1 wherein said primer powder has been formed by spray drying.

15. The process of claim 1 wherein said substrate is selected from a group consisting of carbon steel, aluminum or aluminized steel.

16. The process of claim 1 wherein said substrate is at a temperature of 15 to 25° C. when steps (a) and (b) are carried out.

17. The process of claim 1 wherein said applying of said overcoat powder on said primer layer is carried out prior to baking said primer layer, whereby said baking of said overcoat layer also bakes said primer layer.

18. The process of claim 1 wherein said applying of said overcoat powder on said primer layer is carried out after baking said primer layer and said overcoat layer is baked after application of said overcoat powder.

19. The process of claim 1 wherein said primer layer is less than 2 mils (50 micrometers) thick and said overcoat layer is no greater than 25 mils (650 micrometers).

20. The process of claim 17 wherein said primer layer is less than 1.5 mils thick.

21. The process of claim 17 wherein said overcoat layer is 1.5 to 3 mils thick (38 micrometers to 76 micrometers).

* * * * *

UNITED STATES PATENT AND TRADEMARK OFFICE

CERTIFICATE OF CORRECTION

PATENT NO. : 7,601,401 B2
APPLICATION NO. : 11/281092
DATED : October 13, 2009
INVENTOR(S) : Craig King Hennessey It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1000 days.

Signed and Sealed this

Fifth Day of October, 2010

David J. Kappos

David J. Kappos
*Director of the United States Patent and Trademark Office*